US005205437A

United States Patent [19]

Elder et al.

[11] Patent Number: 5,205,437

[45] Date of Patent: Apr. 27, 1993

[54] SINGLE ARTICLE NEWSPAPER DISPENSING APPARATUS

[75] Inventors: Richard A. Elder, Springfield; Norman C. Locati, Lake Oswego; R. Wayne Fields, Gladstone, all of Oreg.

[73] Assignee: Univend, Inc., Lake Oswego, Oreg.

[21] Appl. No.: 746,788

[22] Filed: Aug. 16, 1991

[51] Int. Cl.[5] ..... B65G 59/00

[52] U.S. Cl. ..... 221/103; 221/155; 221/232; 221/238; 221/241; 221/244

[58] Field of Search ..... 221/151, 152, 155, 191, 221/194, 195, 213, 227, 232, 238, 241, 244, 251, 270, 92, 103, 107, 108

[56] References Cited

U.S. PATENT DOCUMENTS

| | | | |
|---|---|---|---|
| 3,685,691 | 8/1972 | Charest et al. | 221/227 X |
| 4,085,864 | 4/1978 | Gordon | 221/155 |
| 4,106,609 | 8/1978 | Kaspar | 221/154 X |
| 4,273,255 | 6/1981 | Overall | 221/213 |
| 4,508,238 | 4/1985 | Johnson et al. | 221/213 X |
| 4,802,606 | 2/1989 | Daniels | 221/195 X |

OTHER PUBLICATIONS

Brochure, "Sho-Rack K-Matic Single Copy Newspaper Dispenser", Berkley-Small Incorporated.

*Primary Examiner*—David H. Bollinger
*Attorney, Agent, or Firm*—Robert L. Harrington

[57] ABSTRACT

A single article dispensing apparatus adapted for newspaper vending captures a bundle of newspapers between opposing support plates with one movable plate being spring biased toward the stationary plate. Newspaper engaging pins extend beyond the stationary support plate and into the space between the opposing support plates to engage the back edge of a newspaper of the bundle. Upon deposit of the necessary coins and pulling of a dispensing handle, the newspaper engaging pins slide the newspaper from the bundle and out through an output door of the vending machine. When all newspapers in the bundle are dispensed and the support plates come to direct face-to-face opposition, a last copy of the newspaper held behind a display window is automatically dispensed upon the next actuation of the dispensing handle. The vending machine restricts access to the inventory of newspapers and allows a purchaser but one copy of the newspaper for payment of one copy.

18 Claims, 8 Drawing Sheets

SINGLE ARTICLE NEWSPAPER DISPENSING APPARATUS

BACKGROUND OF THE INVENTION

The present invention relates generally to vending machines and particularly to coin operated newspaper vending machines adapted for single article dispensing.

Newspapers are made available to the public in coin operated vending machines. The customer inserts coins to actuate a latch release mechanism and obtain a newspaper. Such newspaper vending machines typically have an enclosure for holding a stack of newspapers and a door allowing access to the stack of newspapers. The door is secured by the coin operated latch release mechanism. The coin actuated latch release mechanism is a relatively complex device having settings for dollar amounts, i.e., how much money is needed to open the door, and a latch engaging element positioned to capture a door latch and release the door latch only upon deposit of sufficient coins. Other than the latch release mechanism, however, newspaper vending machines are simple mechanical devices comprising little more than a locked box with a display window. They are easy to load by simply opening the door and depositing a stack of newspapers within the enclosure.

Conventional newspaper vending machines suffer, however, one serious disadvantage: the customer has access to all the newspapers within the enclosure upon payment for a single newspaper. While most people are happy to take a single copy of the newspaper, many are inclined to take more than one copy. As a result, newspaper concerns, especially newspaper distribution companies, suffer financial loss for each newspaper taken without payment. It is estimated that up to fifty percent of the newspapers placed in a machine may be taken without payment. For a distribution company making extensive use of street vending machines, this is a significant loss of income.

Eliminating access to the entire inventory of newspapers within a vending machine is desirable, but greatly complicates newspaper vending machine design and operation. Acceptable single newspaper vending machines have not been available. Newspapers are not well adapted for single vend applications. The paper is thin and tears easily. The thickness and weight of each newspaper varies daily, and for Sunday editions the thickness and weight of each newspaper increases dramatically. From the worker's perspective, a newspaper vending machine requiring individual manipulation of newspapers, e.g. by placement of each copy in separate slots for separate delivery, is unacceptable. Newspaper distribution workers expect to handle newspapers quickly and efficiently as in bundles, without manipulating individual newspapers. Finally, a single article newspaper vending machine cannot be overly expensive. The typical profits available from each machine do not warrant an expensive implementation of a newspaper vending machine.

Also, a newspaper vending machine must be strictly mechanical, since even battery electrical power would impose undesirable constraints.

A newspaper vending machine should, therefore, dispense single newspapers while permitting convenient loading by placement of entire newspaper bundles, without manipulating individual newspapers. The machine should be adapted to dispense individual newspapers, as taken from the bundle, without damaging the newspapers. Also, the machine should be of reasonable cost with respect to profit available from the machine. The present invention provides such a newspaper vending machine.

SUMMARY OF THE INVENTION

In accordance with a preferred embodiment of the present invention, a single article dispensing apparatus discharges from an enclosure a single newspaper upon payment for a single newspaper. The machine includes an output door and a dispensing handle having a portion accessible from the exterior of the enclosure for actuation by the customer. A pair of support plates in face-to-face relation within the enclosure capture a bundle of newspapers. One support plate, the backplate, is adjacent the output door and a biasing arrangement moves the other support plate, the advance plate, toward the backplate. A newspaper dispensing arrangement within the enclosure and responsive to actuation of the dispensing handle slides the leading newspaper, i.e. the one held against the backplate, through the output door. The next newspaper in the bundle is then advanced against the backplate in preparation for its discharge.

According to one aspect of the present invention, the newspaper dispensing arrangement is well adapted for manipulation of variable thickness newspapers. In the preferred embodiment, a plurality of newspaper engaging pins extend through corresponding slots in the backplate and move toward the output door in response to actuation of the dispensing handle. The extent to which the pins protrude into the region between the plates is variable according to newspaper thickness. The pins engage only the back edge of the leading newspaper for sliding that newspaper through the output door.

According to a second aspect of the present invention, the biasing arrangement provides a first component of pulling force having substantially constant magnitude and a second component of diminishing magnitude pulling force as a function of the separation between the support plates. In this manner when a full inventory of newspapers are to be advanced by the biasing arrangement the maximum pulling force is provided, but as the support plates come together and the inventory is discharged then a corresponding lesser magnitude pulling force is provided. In any case, at least the constant magnitude pulling force is provided as a minimum biasing force to maintain the leading newspaper suitably against the backplate. In the preferred embodiment, a roller bar is rotatably mounted upon the machine and positioned on an opposite side of the backplate relative to the advance plate. Constant force extension springs having proximal length portions encircling the roller bar and distal length portions extending from the roller bar and past the backplate couple to the advance plate to provide constant magnitude pulling force on the advance plate. The extension springs bias the roller bar into rotation as they pull the advance plate toward the backplate. A coil spring encircles a central shaft of the roller bar and also biases the roller bar into rotation. As the extension springs coil about the roller bar, the advance plate is pulled toward the backplate under a diminishing magnitude pulling force.

According to another aspect of the present invention, the above mentioned extension springs rest on rails and directly support the bundle of newspapers, the rails in turn supporting the extension springs. The extension springs slide on top of the rails as the newspaper bundle advances toward the backplate. In this manner the newspapers are stationary with respect to the extension springs to minimize the potential for tearing and abrading of the newspapers as they advance toward the backplate.

In another aspect of the present invention, a last newspaper dispensing mechanism is provided by a display compartment adapted for holding a last newspaper and making visible the last newspaper from exterior of the enclosure. A last newspaper discharge arrangement delivers the last newspaper out of the enclosure in response to actuation of the dispensing handle following discharge of all of the inventory except the last newspaper. Customers seeing the empty display window then know no further newspapers are available from the machine. In the preferred embodiment, the last newspaper discharge arrangement is a trap door at the bottom of the display compartment and adapted for supporting the last newspaper. The trap door is pivotable down and away from the last newspaper to allow it to drop from the display compartment and out of the enclosure. A trip arrangement, however, blocks such pivoting of the trap door until discharge of all of the newspaper inventory. As applied to a newspaper vending machine having the above mentioned backplate and advance plate, the advance plate carries a slide bar for engaging the trip arrangement when no newspapers remain between the plates and the dispensing handle is next actuated.

It is, therefore, an object of the present invention to provide a single article dispensing apparatus adapted for dispensing a single newspaper in response to payment for a single newspaper. The vending machine of the present invention accepts a load of newspapers in bundle form without requiring the operator to handle individual newspapers. The machine advances the newspapers without tearing or abrading the newspapers and is adapted for manipulation of variable thickness newspapers according to daily variation in newspaper thickness.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show the same may be carried into effect, reference will now be made, by way of example, to the accompanying drawings in which.

FIG. is a perspective view of a coin operated single newspaper vending machine in accordance with a principal embodiment of the present invention.

DETAILED DESCRIPTION

Figure 1:
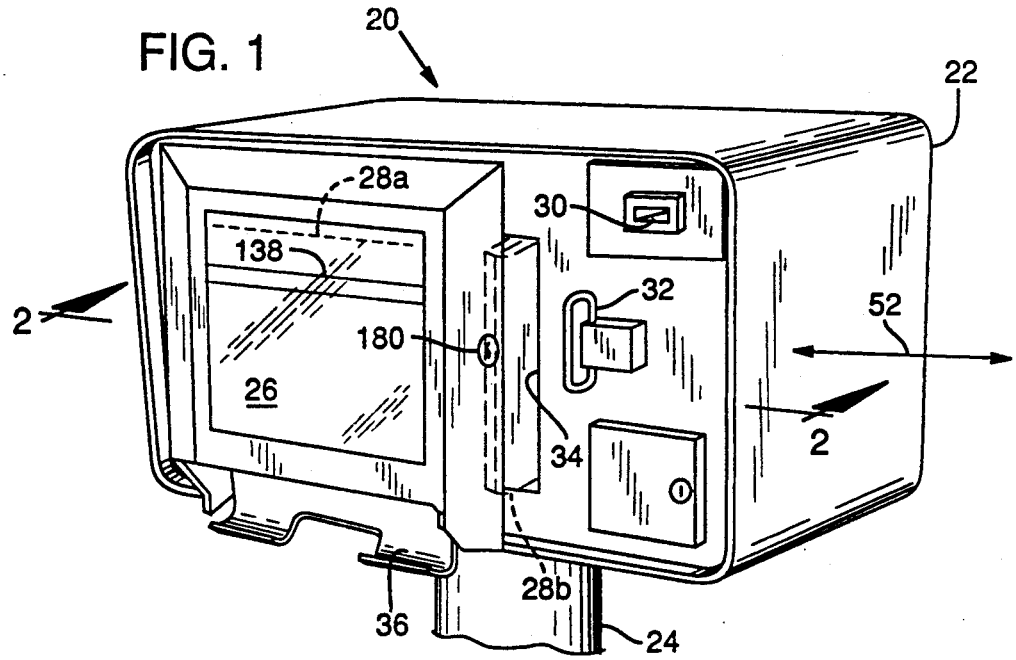

FIG. 1 illustrates in perspective a coin operated newspaper vending machine 20 according to the present invention. In FIG. 1, vending machine 20 includes an enclosure box 22 supported by a pedestal 24. Enclosure 22 should be of sufficient structural integrity to prevent unauthorized access to its interior. Pedestal 24 may be adapted for mounting to, for example, a sidewalk for preventing theft of machine 20 and its contents. Also, multiple enclosures 22 may be stacked vertically for dispensing a larger inventory of newspapers, or different newspaper publications.

Vending machine 20 dispenses one newspaper upon deposit of the necessary coins. A customer has access to and obtains only one newspaper for payment of one newspaper. A newspaper distributor using machine 20 thereby avoids losses associated with conventional newspaper vending machines providing access to the entire newspaper inventory upon payment for one copy.

Machine 20 includes a display window 26 behind which rests a display newspaper 28*a*, showing the front page of the current newspaper inventory held within box 22. To operate machine 20, a customer deposits coins in coin slot 30 and pulls dispensing handle 32. A conventional coin actuated latch release mechanism captures a latch of handle 32 and permits movement of handle 32 following deposit of the necessary coins. As handle 32 moves forward and toward the customer, machine 20 ejects from output door 34 a portion of newspaper 28*b* taken from the newspaper inventory within box 22. The customer then pulls newspaper 28*b* from machine 20 and output door 34 snaps shut.

Once the inventory of newspapers within box 22 is fully dispensed in this manner and upon the next coin deposit and actuation of handle 32, machine 20 automatically releases display copy 28*a* from behind display window 26 and onto tray 36 of machine 20. Display window 26 is then empty, indicating that no more newspapers are available from machine 20.

Figure 2A:
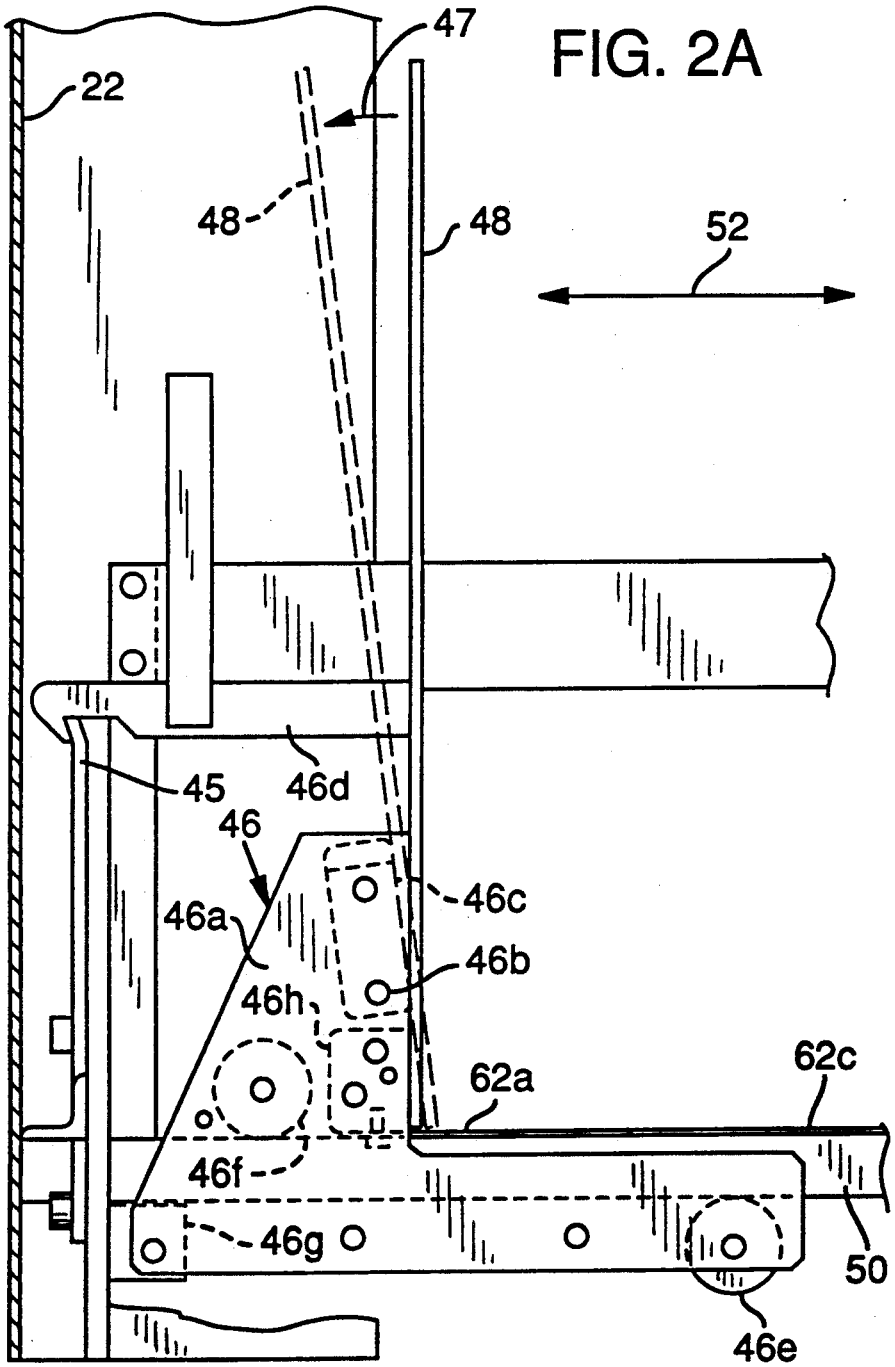
FIGS. 2A and 2B, illustrate a portion the interior components of the vending machine of FIG. 1 as taken along lines 2—2 of FIG. 1.
Figure 2B:
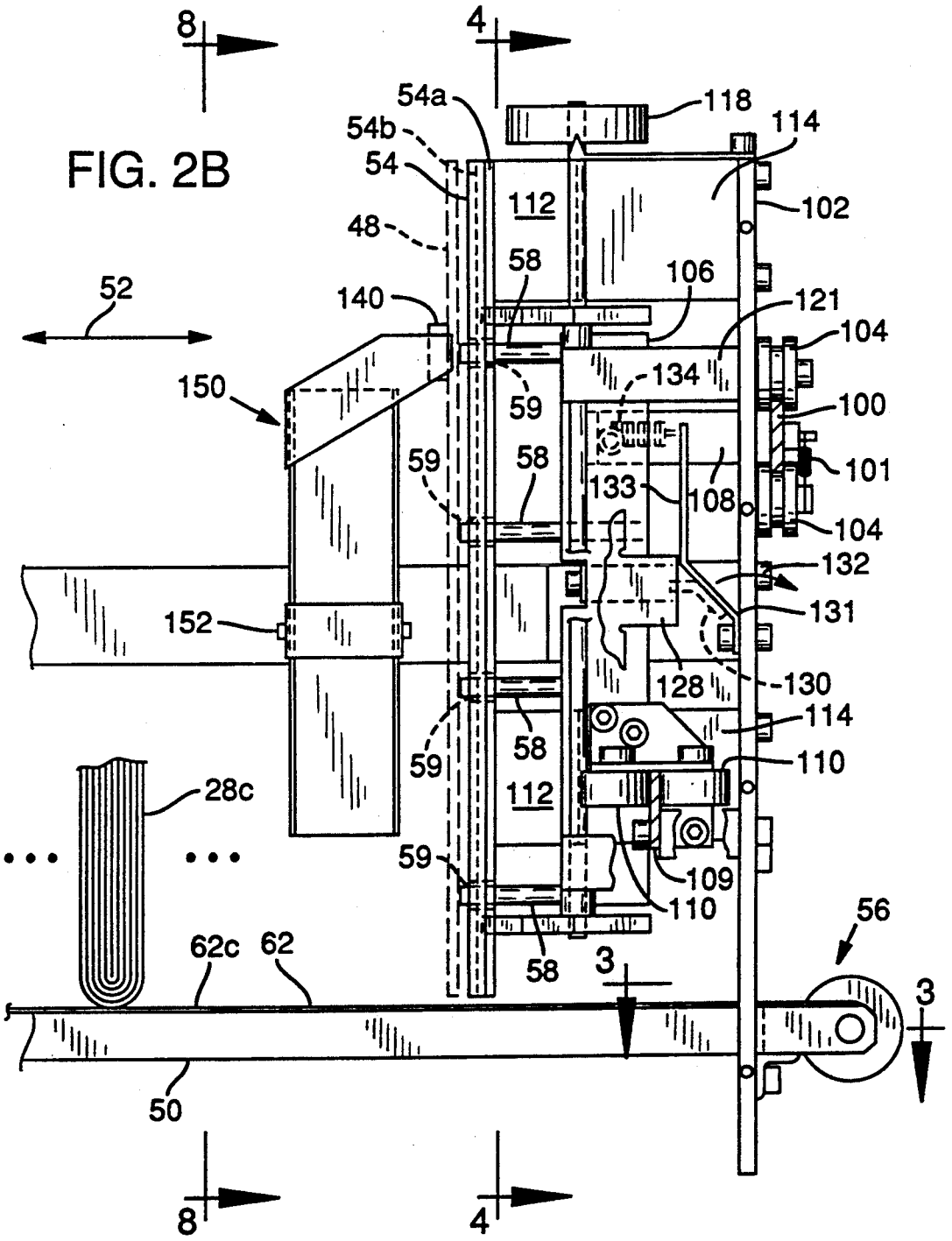

FIGS. 2A and 2B, a single view broken into separate sheets, show some of the interior components of machine 20. A newspaper bundle carriage assembly 46 carries an advance plate 48. Carriage assembly 46 mounts slidably upon a pair of rails 50 (one being shown in FIGS. 2A and 2B) for right and left movement along the transverse axis 52 (FIG. 1). The right most position for advance plate 48 appears in phantom in FIG. 2B. As used herein, the terms "right" and "left" when applied to machine 20 or parts of machine 20 shall be with reference to the right and left ends of axis 52 as shown in FIGS. 1–2B. The terms "forward" and "rearward" or the terms "front" and "rear" when applied to machine 20 or parts of machine 20 shall be with reference to the near and far, respectively, sides of transverse axis 52 as shown in FIGS. 1–2B

Figure 8:
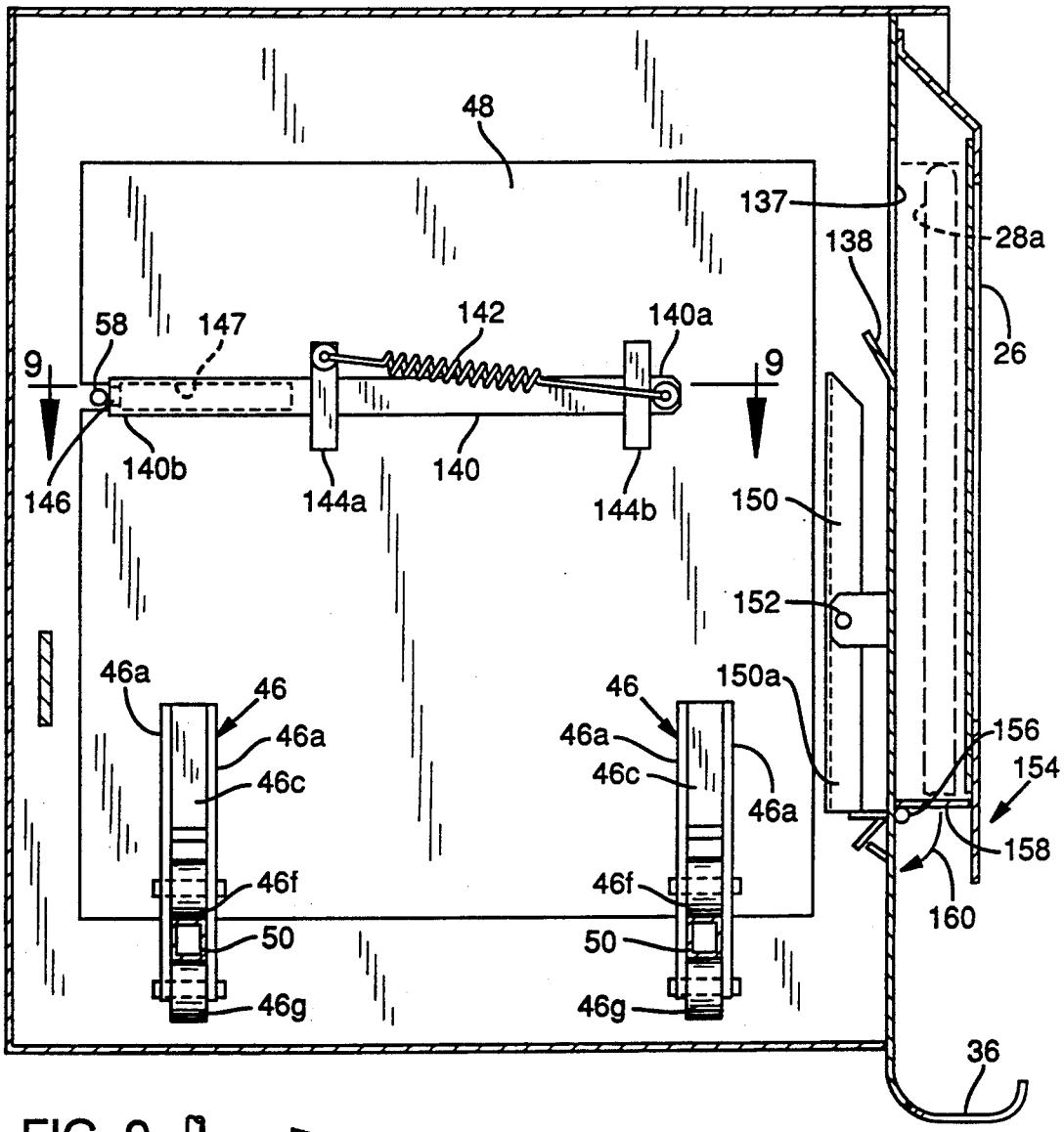
FIG. 8 is a sectional view of the newspaper dispensing apparatus taken along lines 8—8 of FIG. 2B and showing the last newspaper discharge mechanism.

In FIG. 2A, newspaper bundle carriage assembly 46 includes four support plates 46*a*, one on each side of each rail 50 (one shown in FIG. 2B, but all shown in FIG. 8). Plates 46*a* carry pivot rods 46*b* rotatably supporting a pair of plate mounting blocks 46*c*, one for each pair of support plates 46*a*. Plate mounting blocks 46*c* carry advance plate 48 for pivotal movement of plate 48 relative to support plates 46*a* as indicated by reference arrow 47. Pivoting of plate 48 from normal vertical orientation to its pivoted position shown in phantom in FIG. 2A facilitates loading of a bundle of newspapers in machine 20. A latch 46*d* of carriage assembly 46 engages a stationary catch 45 of enclosure 22 to retain plate 48 in its pivoted position when loading newspapers in machine 20. As explained hereafter, carriage assembly 46 is spring biased in the rightward direction, and the latch 46*d* secures carriage assembly 46 against rightward movement when loading a bundle of newspapers in machine 20.

Carriage assembly 46 further includes rollers 46*e*, one between each pair of support plates 46*a*, positioned to the right of plate 48 on the lower side of each rail 50 and rollers 46*f*, one between each pair of support plates 46*a* and positioned to the left of plate 48 on the upper side of each rail 50. Slide blocks 46*g*, one between each pair of support plates 46*a*, positioned to the left of rollers 46*f* each slidably engage the lower surface of the corresponding rail 50. The rollers 46*e* and 46*f* mount rotatably on the corresponding pairs of plates 46*a* and together with blocks 46*g* provide the desired slidable mounting of carriage assembly 46 upon rails 50, i.e., right and left movement of newspaper bundle carriage assembly 46.

In FIG. 2B, backplate 54, positioned toward the right side of machine 20 in the vicinity of output door 34 (FIG. 1), opposes in face-to-face relation the advance plate 48. A spring bias assembly 56 pulls advance plate 48 rightward toward backplate 54. With plate 48 spring biased toward plate 54, plates 48 and 54 capture therebetween a bundle of newspapers 28, with sheet elements of each newspaper in parallel relation to plates 48 and 54 and with the newspaper folds at the bottom as indicated by newspaper 28*c* in FIG. 2B. Newspaper engaging pins 58 adjustably extend into the space between plates 48 and 54 and engage the back edge of the leading newspaper, i.e., the newspaper currently held against plate 54. Backplate 54 includes slots 59 each corresponding to one of pins 58 for allowing movement of pins 58 relative to plate 54 with pins 58 extending through plate 54.

Pins 58 move toward output door 34 in response to movement of dispensing handle 32 to slide the leading newspaper along backplate 54 and through output door 34. Specifically, the leading newspaper is substantially aligned with output door 34 and, in response to actuation of handle 32, pins 58 slide the leading newspaper between backplate 54 and the next newspaper in the bundle for delivery through output door 34. Spring bias assembly 56, urging advance plate 48 against the bundle 28 and toward backplate 54, delivers the next newspaper in the bundle against backplate 54 as the new leading newspaper and in position for delivery through door 34.

The relative orientation of plates 48 and 54 provide an opening funnel formation for permitting movement of the leading newspaper away from the newspaper bundle 28 and through output door 34. More particularly, the plates 48 and 54 are more widely separated at their forward edges, near output door 34, to reduce constriction along the dispensing path for the leading newspaper. The orientation of advance plate 48 relative to transverse axis 52 is substantially normal, i.e. the transverse axis 52 is perpendicular to the plane of advance plate 48. Backplate 54, however, is positioned at an angle relative to transverse axis 52 and advance plate 48. More particularly, the forward edge 54*a* (FIG. 2B) of plate 54 is more widely separated from advance plate 48 than the rear edge 54*b* of plate 54. As the leading newspaper is engaged at its rear edge and moved forward toward output door 34, the space between backplate 54 and the next newspaper in the bundle widens to allow the leading newspaper to break free of the bundle and emerge from output door 34.

Figure 3:
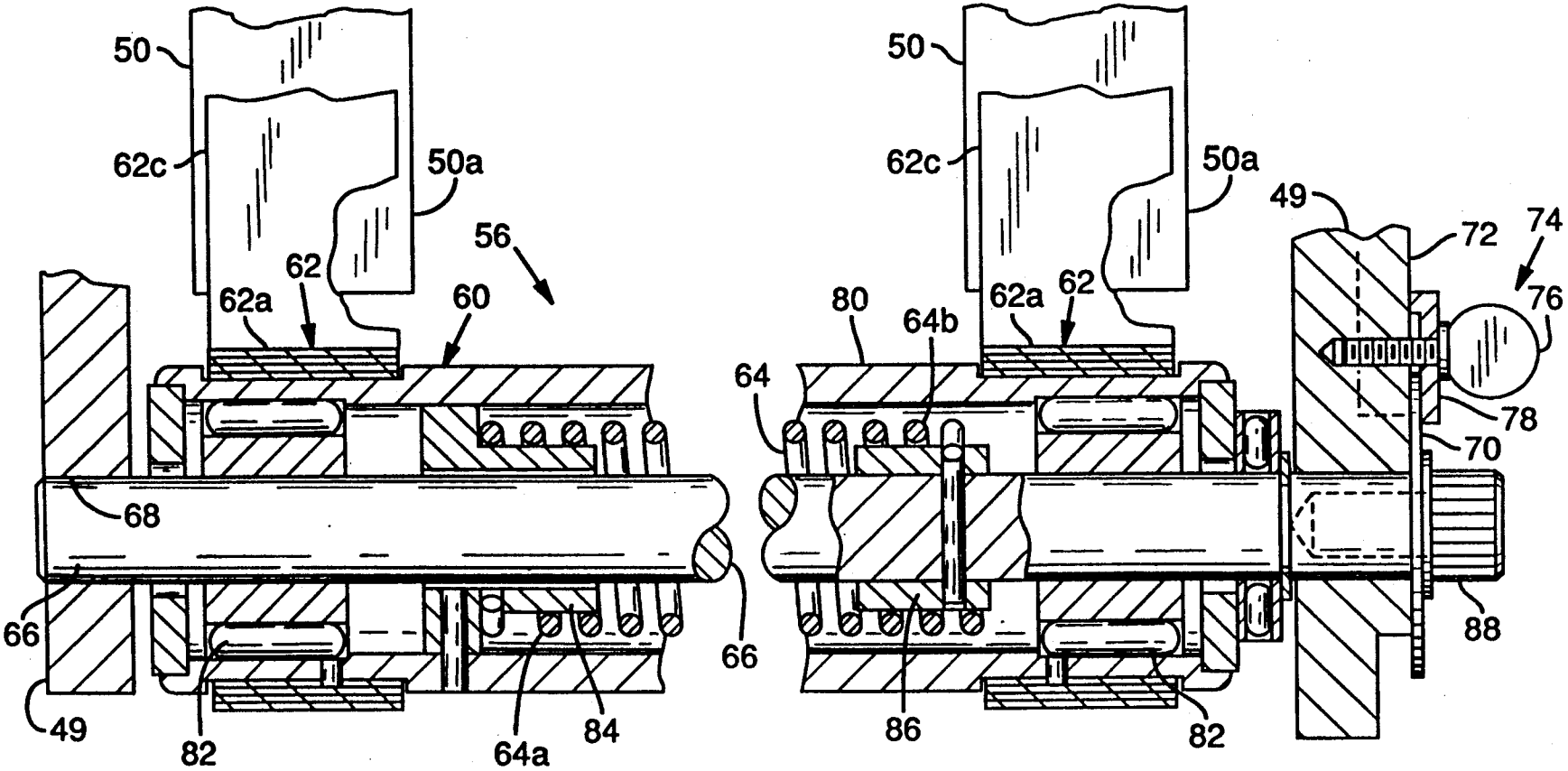
FIG. 3 is a sectional view of a spring bias assembly of the machine of FIG. 1 taken along lines 3—3 of FIG. 2B.

In FIGS. 2A, 2B, and 3, spring bias assembly 56 includes a roller bar 60 rotatably upon a frame 49 mounted near the right ends 50*a* (FIGS. 2B and 3) of rails 50 and a pair of constant force flat stock extension springs 62 each having a distal end 62*a* (FIG. 2A) coupled to the advance plate 48 and having a proximal end 62*b* wrapped about roller bar 60. The distal ends 62*a* of springs 62 attach to the undersurface of spring blocks 46*h* (FIG. 2A) of carriage 46. Blocks 46*h* are each mounted between corresponding pairs of support plates 46*a* and slightly above the corresponding rail 50. Extension springs 62 of the preferred embodiment are sold under the product name NEG'ATOR and each provide a constant magnitude force of approximately 1.98 pounds as available under the part number SK10J32. In the illustrated configuration for springs 62, each spring 62 tends to further coil itself about the roller bar 60 resulting in drawing of the distal length portion 62*c* about roller bar 60 and urging of roller bar 60 into clockwise rotation in the view of FIG. 2B. A coil spring 64 mounts concentrically within roller bar 60 for also biasing roller bar 60 into clockwise rotation (in the view of FIG. 2B). In the preferred embodiment, spring 64 is a torque spring providing between 0 and 12 pounds force through the right to left, respectively, range of movement of advanced plate 48.

Roller bar 60 includes a central shaft 66 (FIG. 3) rotatably disposed within apertures 68 of frame 49, but selectively held against rotation relative to frame 49. More particularly, shaft 66 carries a disk 70 adjacent a surface 72 of frame 49 and a locking assembly 74 presses disk 70 against surface 72 to hold shaft 66 against rotation. Locking assembly 74 includes a manually adjustable screw 76 threadably engaging frame 49 for capturing disk 70 between a locking plate 78 and surface 72.

Roller bar 60 also includes a cylinder 80 carried upon shaft 66 by way of bearing mounts 82. Cylinder 80 rotates relative to shaft 66 under the influence of extension springs 62 and coil spring 64. Coil spring 64 encircles shaft 66 and couples shaft 66 and cylinder 80. A first end 64*a* of spring 64 attaches to block 84 of cylinder 80 while the opposite end 64*b* attaches to block 86 of shaft 66. A selected magnitude of preloading in spring 64 is provided by re easing locking mechanism 74 and turning knob 88 of shaft 66 while holding stationary the cylinder 80. Once a desired magnitude of preloading is achieved, locking assembly 74 is engaged to hold shaft 6 against rotation and maintain suitable tension in spring 64 for urging cylinder 80 into clockwise rotation (as viewed in FIG. 2B). Extension springs 62, each being wrapped about cylinder 80 and extending across the corresponding rail 50 to the advance plate 48, also urge cylinder 80 into similar clockwise rotation.

The combined force of extension springs 62 and coil spring 64 draws extension springs 62 about cylinder 80 and thereby pulls advance plate 48 toward backplate 54. Extension springs 62 provide a substantially constant magnitude pull on advance plate 48 while coil spring 64 provides a diminishing magnitude pull on advance plate 48 as plate 48 comes closer to backplate 54. The spring biasing assembly 56 thereby provides a component of constant minimum magnitude pull, the contribution of extension springs 62, and a component of diminishing magnitude pull, the contribution of coil spring 64 as a function of advance plate 48 position.

When a full bundle of newspapers is loaded in machine 20, requiring a relatively greater magnitude pulling force on advance plate 48 to move the bundle toward backplate 54, spring biasing assembly 56 provides its maximum pull. As the newspaper bundle diminishes, requiring a relatively lesser magnitude pulling force, spring bias assembly 56 reduces the force applied to advance plate 48, but always provides at least the force contribution of extension springs 62. In the illustrated embodiment of the present invention, the extension springs 62 provide approximately four pounds pulling force on advance plate 48 and coil spring 64 is adjusted to provide approximately zero pounds pulling force on advance plate 48 when plate 48 is in its rightmost position, i.e. adjacent backplate 54. When plate 48 is fully retracted to the left, coil spring 64 provides approximately twelve pounds pulling force. With a full load of newspapers, the pulling force of coil spring 64 is sufficient to advance the bundle 48 toward backplate 54, i.e. overcome frictional forces associated with supporting the weight of the bundle, but contributes little to the force applied to the leading newspaper against backplate 54. The pulling force contribution of extension springs 62, however, maintains approximately four pounds of pressure holding the leading newspaper against backplate 54. The diminishing pull of coil spring 64 is thereby coordinated with the amount of force needed to advance the newspaper bundle while the substantially constant force of springs 62 holds the leading newspaper against backplate 54, whether a full bundle or only one newspaper is captured between advance plate 48 and backplate 54.

Returning to FIGS. 2A and 2B, extension springs 62 additionally serve as carriers for the newspaper bundle captured between plates 48 and 54. The length portion **62*c* of each spring 62 rests slidably upon rails 50 and receives thereon the bundle of newspapers 28. It is suggested that the upper surface of rails 50 include, for example, Teflon brand low friction tape for minimizing sliding friction exerted upon the under surface of length portion 62*c*. Length portion 62*c* slides to the right atop rails 50 as it wraps about cylinder 80 and pulls advance plate 48 rightward toward backplate 54. Length portion 62*c* is stationary, however, with respect to advance plate 48 and with respect to the newspaper bundle between plates 48 and 54. Thus, in advancing newspapers toward backplate 54, each newspaper is held by relatively stationary components of machine 20**, i.e. not engaged by parts moving relative to the newspapers. Damage such as tearing or abrading of the newspapers is substantially avoided.

Figure 4:
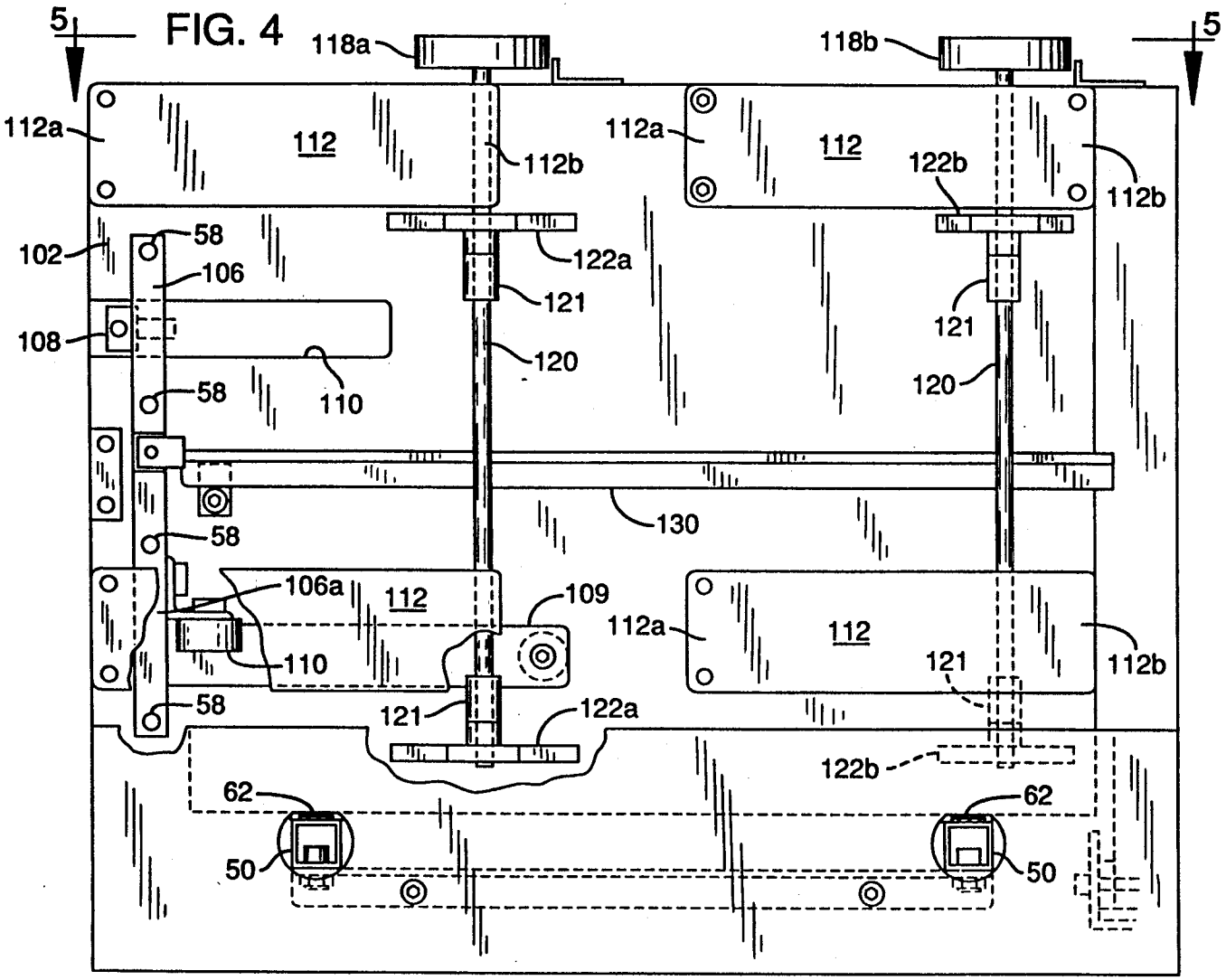
FIG. 4 is a sectional view of the vending machine taken along lines 4—4 of FIG. 2B.
Figure 5:
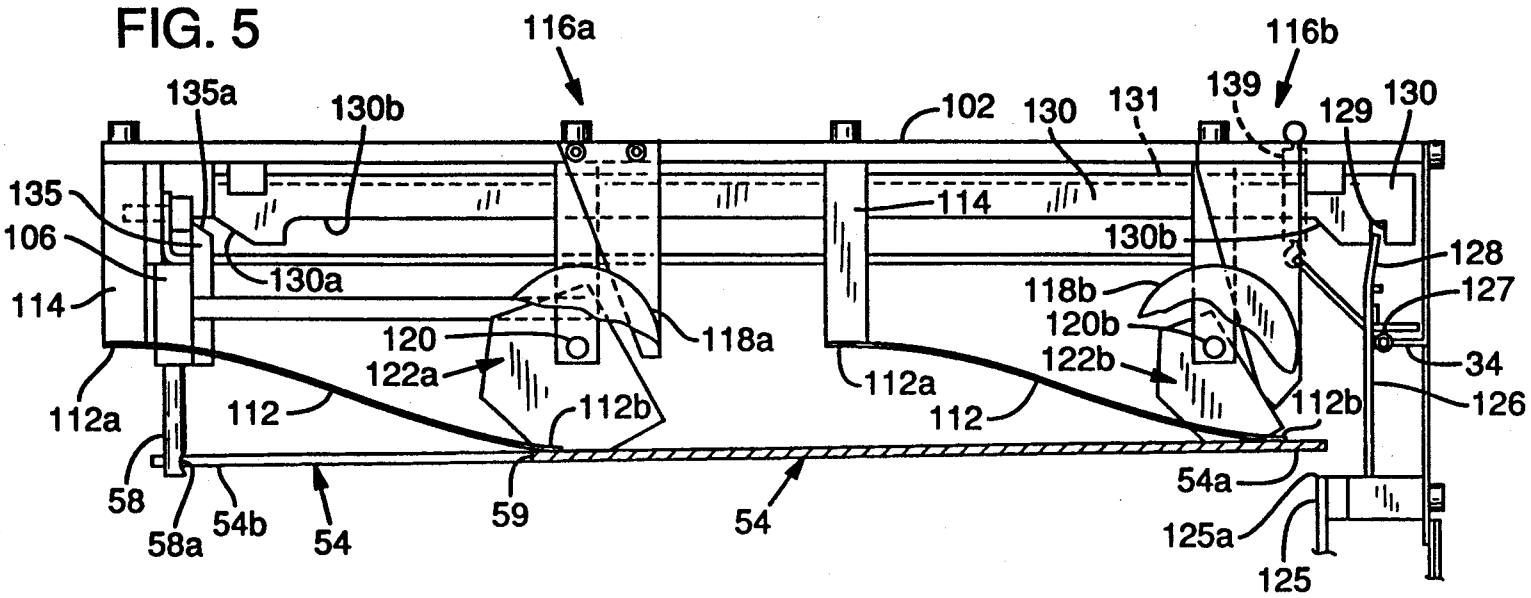
FIG. 5 is a top view of a portion of the vending machine taken along lines 5—5 of FIG. 4.

Actuation of newspaper engaging pins 58, to eject a newspaper from door 34, will now be described with reference to FIG. 2B in conjunction with FIGS. 4 and 5. FIG. 4 is a sectional view of the newspaper dispensing machine taken along lines 4—4 of FIG. 2B and FIG. 5 is a top view of the newspaper dispensing machine taken along lines 5—5 of FIG. 4. In FIG. 2B, a handlebar 100 affixed to handle 32 (FIG. 1) mounts slidably along on interior side wall 102. Specifically, handlebar 100 is captured between bar rollers 104 (handlebar 100 and rollers 104 are omitted in FIG. 5), mounted to wall 102 and allowing forward and rearward movement of handlebar 100 along its longitudinal axis directly in response to similar movement of dispensing handle 32. A spring 101 (FIG. 2B) coupling handlebar 100 and wall 102 biases handlebar 100 in the rearward direction to return dispensing handle 32 to its normal position following discharge. Handlebar 100 couples by way of coupling arm 108 through wall 102 to a vertically disposed pin mounting structure 106.

With reference to FIG. 4, the wall 102 includes a slot 110 allowing movement of coupling arm 108 while extending through wall 102. Pin mounting structure 106 carries four vertically aligned and horizontally disposed newspaper engaging pins 58. Pins 58 remain substantially stationary along their longitudinal axes, i.e., do not move left or right, but do move forward and rearward, i.e., transverse to their longitudinal axes, directly in response to actuation of dispensing handle 32.

Pin mounting structure 106 is maintained vertical by a stabilizing plate 109 affixed in spaced parallel relation to the wall 102. The lower end **106*a* of pin mounting structure 106 carries a pair of stabilizing rollers 110 positioned on opposite sides of stabilizinq plate 109 and each rotatable about a vertical axis. Stabilizing rollers 110 capture the stabilizing plate 109 therebetween, but allow the desired forward and rearward movement of pin mounting structure 106 in response to actuation of handle 32**.

Referring now to FIGS. 2B, 4 and 5, pins 58 adjustably extend into the space between plates 48 and 54 by positioning of backplate 54 relative to wall 102. Leaf springs 112 support backplate 54 and bias backplate 54 toward the wall 102. Each leaf spring 112 includes a proximal end **112*a* fixedly mounted to wall 102 by way of a spring block 114. The distal end 112*b* of each spring 112 attaches to the plate 54 to bias plate 54 toward wall 102. Travel of plate 54 toward wall 102 is limited, however, by a plate cam assembly 116 providing selected positioning of plate 54 relative to wall 102 and therefore positioning of pins 58 relative to plate 54**.

Plate cam assembly 116 comprises a pair of adjusting knobs 118, each knob 118 being carried upon a corresponding vertical shaft 120 rotatably mounted upon blocks 121 with blocks 121 attached to and extending from wall 102. Each vertical shaft 120 carries a pair of cams 122 for engaging plate 54 and limiting its travel toward wall 102.

The radial dimension of each cam 122 relative to shaft 120 determines the extent to which the plate 54 may travel toward wall 102, and therefore the extent to which pins 58 extend through slots 59 of plate 54. Each pair of cams 122 on a given shaft 120 are identical for maintaining plate 54 substantially vertical, but the cam 122 pairs on different shafts 120 may differ according to the desired positioning of plate 54. Generally, the cams 122*a* of rear cam assembly 116*a* position the rear portion of plate 54 relative to pins 58 and the cams 122*b* of forward cam assembly 116*b* position the forward portion of plate 54 relative to output door 34.

Figure 6:
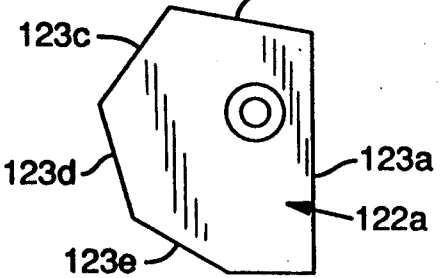

In FIG. 6, each cam 122*a* of rear cam assembly 116*a* includes six flat portions 123, individually numbered 123*a*–123*e*, each providing a predetermined position for plate 54 relative to wall 102 and therefore a predetermined pin 58 extension beyond the plane of plate 54. While the illustrated embodiment shows six discrete predetermined positions for the pins 58 relative to the plate 54, it may be appreciated that variations may be made in the shape of cams 122*a* for providing continuous positioning capability of pins 58, or a greater number of flat portions 123 for more predetermined positions. The illustrated flat portions 123 in the cams 122*a*, however, have proven acceptable for positioning of pins 58 relative to plate 54 to engage a variety of newspaper thicknesses commonly dispensed by a newspaper vending machine.

Figure 7:
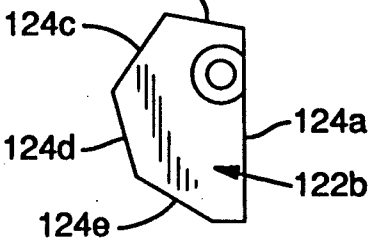
FIGS. 6 and 7 illustrate cam elements of an adjustment mechanism for manipulation of newspapers according to thickness.

In FIG. 7, cams 122*b* of forward cam assembly 116*b* provide a similar positioning function of plate 54, but for the forward portion of plate 54 with respect to output door 34. The forward cams 122*b* include six flat portions 124, individually numbered 124*a*–124*e*, for providing six discrete positions for the forward portion of plate 54 relative to output door 34. The cam assembly 116*b* determines positioning of the left face of the leading newspaper relative to output door 34. More particularly, the interior or rear side of output door 34 defines a stop block 125 (FIG. 5) positioned to engage the forward edge of the next newspaper, i.e., the newspaper adjacent the leading newspaper. By so blocking forward movement of the next newspaper, the next newspaper does not follow the leading newspaper through output door 34. Positioning of backplate 54 by cam assembly 116*b* determines relative positioning of the next newspaper to stop block 125 for suitable engagement of stop block 125 by the next newspaper. In the preferred embodiment, backstop 125 defines a 90° corner 125*a* as the entry into the passageway of door 34. Such corner 125*a* better engages the next newspaper as a rounded corner behaves unpredictably in sometimes allowing the next newspaper to slip through door 34.

Thus, for a given newspaper thickness, machine 20 may be adjusted by positioning of plate 54 relative to pins 58 to suitably engage the leading newspaper for discharge, and relative to door 34 to suitably block forward travel of the next newspaper. By coordinating the relative setting of cams 122*a* and 122*b*, the abovedescribed opening funnel relation between plates 48 and 54 is achieved, i.e., the forward edges of plates 48 and 54 are more widely separated then the rear edges. In practice, for each daily newspaper publication a given setting for cams 122 is used. For example, by designating each of the six settings for cams 122*a* and 22*b* by letters A–E, a given newspaper thickness is accommodated by a given cam setting, e.g., setting C–A. In each case, the setting for cam assembly 116*b* should always be greater than the cam setting for cam assembly 116*a* to suitably obtain the above-described opening funnel relation between plates 48 and 54.

Figure 9:
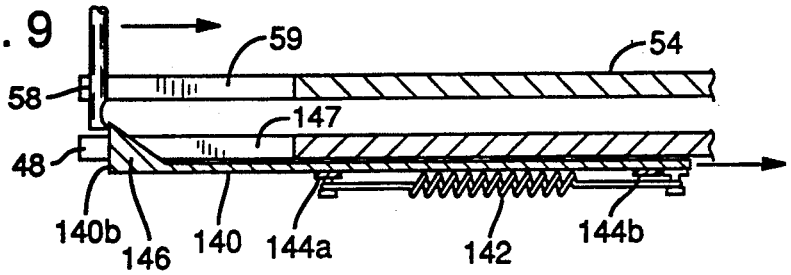
FIG. 9 is a sectional view taken along lines 9—9 of FIG. 8 showing the last newspaper discharge mechanism of the vending machine.

With reference to FIGS. 5 and 9, pin 58 may be modified to better engage the rear edge of the leading newspaper. Thus, each pin 58 includes a cut away formation 58*a* at its distal end and facing forward in order to provide a hook-like structure for engaging the back edge of the leading newspaper. In this regard, the pins 58 typically need only engage a few sheet members of the newspaper. For example, engagement of one fourth or less of the thickness of a typical newspaper has proven sufficient. It will be understood, however, that variations in desirable engagement of newspapers by pins 58 are a function of many factors such as the frictional relation among particular newspaper material and against plates 48 and 54 as well as the magnitude of biasing force applied to plate 48 by bias assembly 56.

To avoid tampering with the newspapers or components of machine 20 output door 34 is latched in a shut position except when suitably actuated by operation of dispensing handle 32. In FIG. 5, a door gate 126 of output door 34 blocks access to the interior of enclosure 22. Door gate 126 pivots about the pivot point 127 and carries a latch 128. Latch 128 normally rests within a notch 129 of a hinge mounted keeper 130. Door gate 126 is free to pivot in the counterclockwise direction, in the view of FIG. 5, when engaged by the dispensed newspaper, but only when keeper 130 is pivoted in such manner to release latch 128 from notch 129.

Referring now to FIGS. 2B and 5, the keeper 130 is hingedly attached along the wall 102 by means of a flexible support member 131 The flexibility of the support member 131 allows clockwise, in the view of FIG. 2B, pivoting of keeper 130 as indicated by the arrow 132 in FIG. 2B. Keeper 132 is biased, however, in the opposite direction by its arm 133 as coupled by a tensioned spring 134 to a stationary component of machine 20. Thus, pivoting of keeper 130 in the direction 132 removes the latch 128 from the notch 129 and allows pivoting of door gate 126 in response to discharge of the newspaper through door 34.

Pivoting of keeper 130 in the direction 132 is provided by a protruding member 135 carried upon pin mounting structure 106. Specifically, an inclined portion of member 135 engages an inclined portion 130*a* of keeper 130 to drive keeper 130 in the direction 132 as pin mounting structure 106 moves in the forward direction in response to actuation of dispensing handle 32. Soon after such forward travel of pin mounting structure 106, however, member 135 reaches a recessed portion 130*b* of keeper 130 whereby member 135 does not prevent keeper 130 from returning to its normal position under the influence of spring 134. A spring 139 biases gate 126 in the clockwise direction. A spring 139 biases gate 126 in the clockwise direction. In this manner, the door gate 126 shuts immediately upon removal of the dispensed newspaper 28*b* and return of latch 127 to notch 129. Keeper 130 also includes an inclined portion 130*b* positioned for engagement by latch 127 to suitably pivot keeper 130 as gate 126 closes and latch 127 reenters notch 129. The potential for tampering with the internal components of machine 20 by way of output door 34 is thereby minimized.

Figure 10:
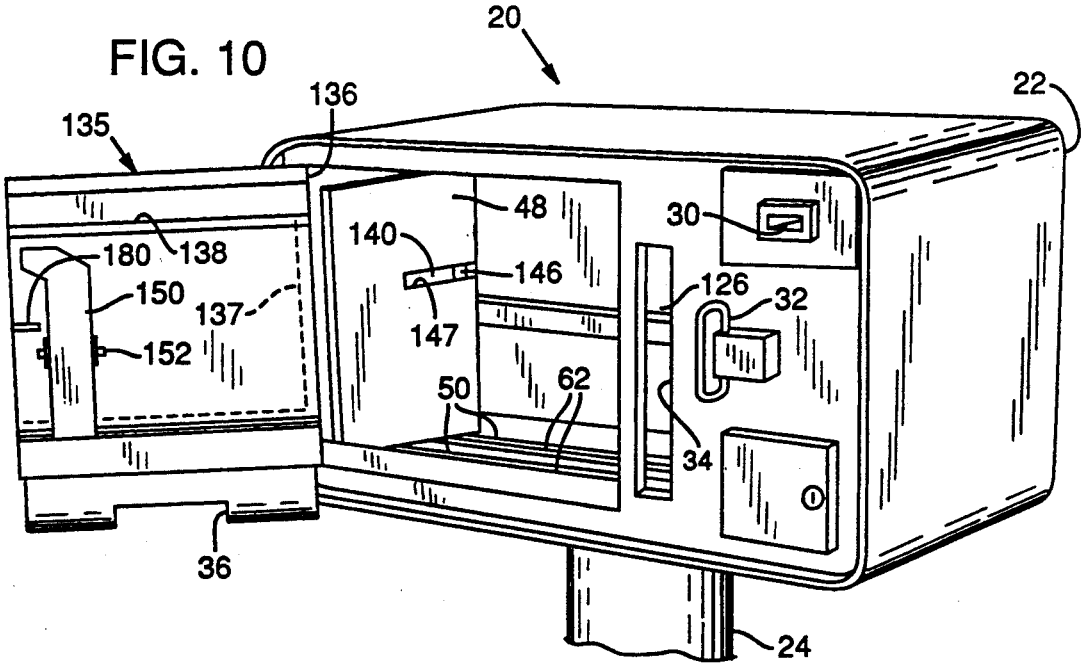
FIG. 10 shows the vending machine of FIG. 1 with an access door opened for loading of newspaper bundles into the vending machine.

When the bundle of newspapers between plates 48 and 54 is exhausted, advance plate 48 comes in direct face-to-face opposition to backplate 54. Referring again to FIG. 2B, advance plate 48 is shown in phantom in such position adjacent plate 54 following discharge of all newspapers of bundle 28. FIG. 8 is a sectional view taken along lines 8—8 of FIG. 2B, but showing the advance plate 48 so positioned adjacent the plate 54 following discharge of all newspapers in the bundle and in anticipation of dispensing the last newspaper 28*a* held behind display window 26. FIG. 9 is a sectional view taken along lines 9—9 of FIG. 8 showing portions of the last paper discharge mechanism. FIG. 10 shows access door 135 opened as when loading a bundle of newspapers into machine 20.

Discharge of last copy 28*a* from behind display window 26 will now be described with reference to FIGS. 2B, 8, 9 and 10. Last newspaper 28*a* is held within access door 135 which is hingedly mounted to enclosure 22 by piano hinge 136. The access door 135 includes a cavity 137 holding last newspaper 28*a*. A slot 138 on the backside of access door 135 and above cavity 137 permits loading of last newspaper 28*a* behind display window 26.

The advance plate 48 carries on its left most surface a slide bar 140. Bar 140 is spring biased in the rearward, i.e., away from display window 26, direction by means of spring 142. Specifically, slide bar 140 rests slidably in support brackets 144 which mount to advance plate 48 and a tension spring 142 couples the rearward bracket 144*a* and the forward end 140*a* of slide bar 140. The rearward end 140*b* of slide bar 140 includes a catch 146 extending through a slot 147 in advance plate 48 and into the space between advance plate 48 and backplate 54. The catch 146 is thereby positioned for engagement by one of pins 58 when plates 48 and 54 are in direct face-to-face opposition, that is to say, with no newspapers therebetween.

Thus, when all newspapers are dispensed from the inventory of newspapers held between plates 48 and 54, the catch 146 is positioned for engagement by a pin 58 and, upon next deposit of coins and actuation of dispensing handle 32, the slide bar 140 moves forward by engagement at its catch 146. The leading end 140*a* of slide bar 140 engages a pivotable trip bar 150 mounted on the backside of access door 135. Trip bar 150 operates to release the last copy 28*a* from display window 26. More particularly, the trip bar 150 pivots clockwise, in the view of FIG. 6, about a pivot rod 152 in response to actuation by slide bar 140.

A trap door assembly 154 of door 135 supports from below the last copy 28*a* held behind display window 26. The trap door assembly 154 pivots about the pivot point 156. With the last newspaper 28*a* resting on the door 158 of trap door assembly 154, trap door assembly 154 is urged toward clockwise rotation, in the view of FIG. 6, but is blocked against such rotation by the lower end 150*a* of trip bar 150. As slide bar 140 engages trip bar 150, however, the lower end 150*a* of trip bar 150 moves away from trap door assembly 154 and allows door 158 to pivot as indicated by reference arrow 160. As trap door 158 pivots in the clockwise direction under the weight of last newspaper 28*a*, last newspaper 28*a* falls through trap door 158 and onto tray 36. Trap door 158 and trip bar 150 are desirably spring biased (not shown) in the counterclockwise direction to return trap door 158 and trip bar 150 to their normal state after discharge of last newspaper 28*a*.

The last copy 28*a* is thereby made available to the customer automatically following discharge of the inventory of newspapers held by vending machine 20. Once the customer removes last copy 28*a* from tray 36, the display window 26 is empty and subsequent customers perceive that no further newspapers are available from vending machine 20.

Figure 11:
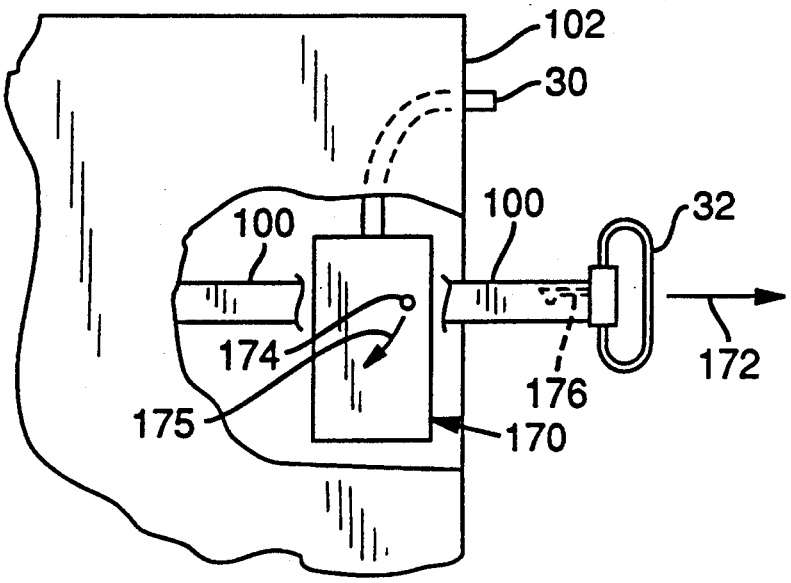
FIG. 11 illustrates the interaction of a dispensing handle and a coin actuated release mechanism of the vending machine of FIG. 1.

FIG. 11 illustrates use of a coin actuated latch release mechanism 170 for controlling movement of the dispensing handle 32. In FIG. 11, the dispensing handle 32 is shown as moved in the forward direction 172 for discharge of newspapers from machine 20. FIG. 11 illustrates the coupling of handle 32 and handlebar 100 for movement of newspaper engaging pins 58 (FIGS. 2B and 4) directly in response to movement of handle 32. The coin actuated latch release mechanism 170 may be mounted on the wall 102, but with the handlebar 100 interposed between wall 102 and release mechanism 170. The release mechanism 170 is a conventional latch release mechanism receiving coins by way of slot 30 and, when sufficient coins have been deposited, dropping a catch bar 174 as indicated at reference numeral 175. Accordingly, the mounting of release mechanism 170 relative to dispensing handle 32 is such to position the catch bar 174 for engagement by a latch 176 of handle 32, the latch 176 being intermediate of handlebar 100 and mechanism 170. With handle 32 in its rearward position, the catch bar 174 engages latch 176 and prevents forward movement of dispensing handle 32. After the customer inserts the proper amount of money through slot 30, release mechanism 170 drops catch bar 174 away from latch 176 and permits movement in the forward direction 172 of dispensing handle 32 resulting in the above-described discharge of newspapers from dispensing machine 20.

In overall operation, the vending machine 20 may be loaded by opening the access door 135 as illustrated in FIG. 10. It may be appreciated that the machine 20 holds substantially the same number of newspapers as does conventional newspaper vending machines. The access door 135 is otherwise secured by a keyed lock 180. With access door 135 opened, the advance plate 48 is retracted to its left most position and secured there by use of latch 46*d*. The cam assembly 116 is then adjusted according to the thickness of the bundle of newspapers to be dispensed by machine 20. A bundle of newspapers may then be deposited upon the extension springs 62 and supported thereunder by rails 50. The latch 46*d* of advance plate 48 is then released allowing spring bias assembly 56 to urge the bundle of newspapers against backplate 54. The last newspaper 28*a* is then deposited in cavity 137 behind display window 26 by insertion through the slot 138 of access door 135. The access door 135 is then shut and secured by lock 180. Dispensing of newspapers from the inventory held between plates 48 and 54 then commences as described above until the inventory of newspapers held between plates 48 and 54 are discharged through output door 34 in the manner described above. Following discharge of this inventory of newspapers, the next actuation of handle 32 releases last newspaper 135 from behind display window 26 and onto tray 36 of machine 20.

Figure 12:
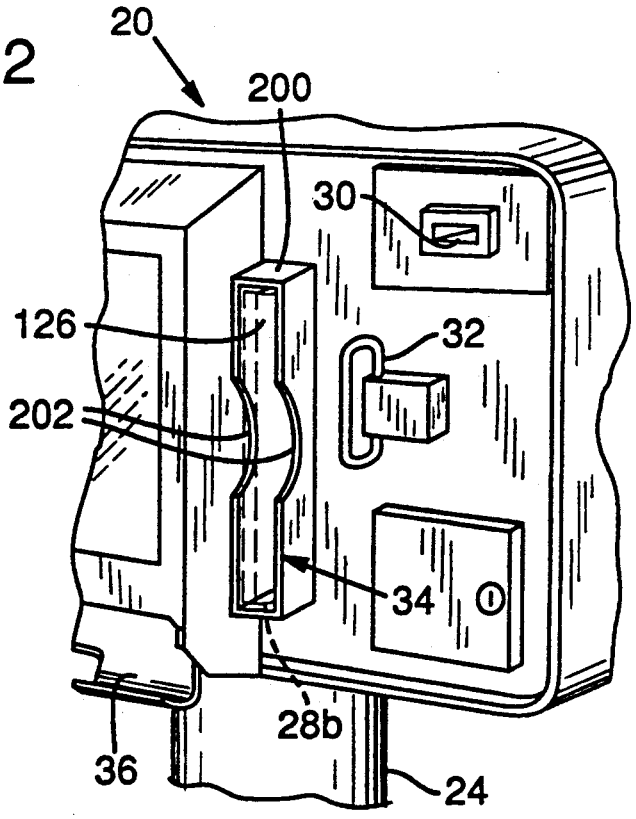
FIG. 12 illustrates a shroud which may be incorporated into the vending machine of FIG. 1.

FIG. 12 illustrates a shroud 200 which may be incorporated into the machine 20 at the output door 34. In FIG. 12, the passageway of door 34 is further defined by a shroud 200 protruding from the front face of machine 20 a distance corresponding to the travel of the dispensed leading newspaper under the influence of pins 58. More particularly, the shroud 200 extends just short of the travel of the leading newspaper to make difficult customer interference with operation of gate 126 and ejection of newspapers from machine 20. Shroud 200 includes cutaway formations 202 allowing the customer to grasp the ejected newspaper from within shroud 200.

Thus, a single article newspaper dispensing apparatus has been shown and described. The apparatus is well adapted for convenient loading of newspapers in bundles without individual manipulation of newspapers. The machine dispenses a single newspaper upon deposit of payment for a single newspaper, and prevents access to the entire inventory of newspapers. Accordingly, revenues from the vending machine 20 correspond directly to the number of newspapers loaded in machine 20, there being no unauthorized taking of extra newspapers from machine 20.

It will be appreciated that the present invention is not restricted to the particular embodiment that has been described and illustrated, and that variations may be made therein without departing from the scope of the invention as found in the appended claims and equivalents thereof. For example, while the present invention has been shown and illustrated for newspaper dispensing, it will be understood that a vending machine according to the present invention may be adapted for dispensing of other products such as magazines.

What is claimed is:

1. A newspaper vending machine for providing newspapers to a customer of the machine, the machine comprising:

an enclosure including an output door;

a dispensing handle having a portion accessible from the exterior of said enclosure for actuation by the customer of said vending machine;

first and second plates in face-to-face relation within said enclosure and adapted for supporting therebetween a bundle of newspapers, the second plate positioned adjacent the output door;

biasing means urging said first plate toward said second plate; and dispensing means within said enclosure and responsive to actuation of said dispensing handle to push one newspaper of said bundle out of said output door.

2. A newspaper vending machine according to claim 1 wherein said one newspaper is adjacent said second plate and slid by said dispensing means between said second plate and an adjacent newspaper of said bundle.

3. A newspaper vending machine according to claim 1 wherein said first and second support plates are substantially vertically disposed whereby sheet members of said newspapers bundle are held in parallel relation to said first and second plates.

4. A newspaper vending machine according to claim 1 further comprising a last newspaper dispensing mechanism, said last newspaper dispensing mechanism comprising:

a display compartment separately holding a last newspaper and making visible said last newspaper from exterior of said enclosure; and last newspaper discharge means for delivering said last newspaper external of said enclosure, said discharge means being responsive to actuation of said dispensing handle following discharge of all of said bundle of newspapers.

5. A newspaper vending machine according to claim 4 wherein said last newspaper discharge means comprises a trap door at the bottom of said display compartment and adapted for supporting said last newspaper, said trap door being pivotable away from said last newspaper to allow said last newspaper to drop from said display compartment and out of said enclosure; and trip means blocking pivoting of said trap door away from said last newspaper until discharge of all of said inventory and a next actuation of said dispensing handle.

6. A newspaper vending machine comprising:

an enclosure including an output door;

a dispensing handle having a portion exterior of said enclosure;

a backplate within said enclosure and adjacent said output door;

newspaper bundle advance means for urging a bundle of newspapers toward and against said backplate whereby sheet members of each newspaper of said bundle are held in parallel relation to said backplate and a leading newspaper of said bundle is held against said backplate; and newspaper dispensing means responsive to customer actuation of said dispensing handle to push said leading newspaper along the surface of said backplate and through said output door.

7. A newspaper vending machine according to claim 6 wherein said newspaper bundle advance means comprises an advance plate in face to face relation to said backplate and biased toward said backplate whereby said bundle of newspapers may be captured therebetween and advanced toward said backplate by said advance plate.

8. A newspaper vending machine according to claim 6 wherein said newspaper bundle advance means comprises:

an advance plate in face to face relation to said backplate an biased toward said backplate;

support means below said backplate and said advance plate, spanning the distance therebetween, and adapted for supporting said bundle of newspapers whereby said bundle of newspapers may be captured between said backplate and said advance plate and urged toward and against said backplate by said advance plate.

9. A newspaper vending machine according to claim 8 wherein said advance means further comprises an extension spring adapted for urging said advance plate toward said backplate while resting intermediate of said support means and said newspaper bundle whereby a portion of said extension spring supports directly said newspaper bundle and remains relatively stationary with respect to said newspaper bundle as said newspaper bundle advances toward said backplate.

10. A newspaper vending machine for providing newspapers to a customer of the machine, the machine comprising:

an enclosure including an output door;

a dispensing handle having a portion accessible from the exterior of said enclosure for actuation by the customer of said vending machine;

first and second plates in face-to-face relation within said enclosure and adapted for supporting therebetween a bundle of newspapers, the second plate positioned adjacent the output door, the relative spacing of the first and second plates being greater near the output door relative to a portion distant from the output door;

biasing means urging said first plate toward said second plate; and dispensing means within said enclosure and responsive to actuation of said dispensing handle to slide one newspaper of said bundle out said output door.

11. A newspaper vending machine for providing newspapers to a customer of the machine, the machine comprising:

an enclosure including an output door;

a dispensing handle having a portion accessible from the exterior of said enclosure for actuation by the customer of said vending machine;

first and second plates in face-to-face relation within said enclosure and adapted for supporting therebetween a bundle of newspapers, the second plate positioned adjacent the output door;

biasing means urging said first plate toward said second plate; and dispensing means within said enclosure and responsive to actuation of said dispensing handle to slide one newspaper of said bundle out said output door, said dispensing means including a backstop positioned adjacent said output door to engage a next newspaper adjacent said one newspaper and prevent said next newspaper from moving out said output door with said one newspaper.

12. A news paper vending machine for providing newspapers to a customer of the machine, the machine comprising:

an enclosure including an output door;

a dispensing handle having a portion accessible from the exterior of said enclosure for actuation by the customer of said vending machine;

first and second plates in face-to-face relation within said enclosure and adapted for supporting therebetween a bundle of newspapers, the second plate positioned adjacent the output door;

biasing means urging said first plate toward said second plate; and dispensing means within said enclosure and responsive to actuation of said dispensing handle to slide one newspapers of said bundle out said output door, said dispensing means including newspaper engaging means responsive to said dispensing handle for engaging a back edge of said one newspaper and urging said one newspaper toward said output door.

13. A newspaper vending machine according to claim 12 wherein said newspaper engaging means comprises a plurality of newspaper engaging pins and said second plate includes a corresponding plurality of slots through which said pins extend into a region between said first and second plates and are allowed movement toward said output door in response to actuation of said dispensing handle.

14. A newspaper vending machine according to claim 12 wherein said newspaper engaging means comprises means for selectively adjusting the relative position of said newspaper engaging means and said second plate corresponding to a thickness of individual newspapers of said newspaper bundle.

15. A newspaper vending machine according to claim 14 wherein said newspaper engaging means comprises a plurality of newspaper engaging pins and said second plate includes a corresponding plurality of slots through which said pins extend into a region between said first and second plates and are allowed movement toward said output door in response to actuation of said dispensing handle, and said relatively adjusting means comprises means for selectively adjusting the position of said second plate relative to said enclosure.

16. A newspaper vending machine for providing newspapers to a customer of the machine, the machine comprising:

an enclosure including an output door;

a dispensing handle having a portion accessible from the exterior of said enclosure for actuation by the customer of said vending machine;

first and second plates in face-to-face relation within said enclosure and adapted for supporting therebetween a bundle of newspapers, the second plate positioned adjacent the output door;

biasing means urging said first plate toward said second plate, said biasing means including a first spring means providing a substantially constant magnitude pull on said first plate toward said second plate, said biasing means further including a second spring means providing variable magnitude pull on said first plate toward said second plate, said variable magnitude pull diminishing as said first plate approaches said second plate; and dispensing means within said enclosure and responsive to actuation of said dispensing handle to slide one newspaper of said bundle out said output door.

17. A newspaper vending machine for providing newspapers to a customer of the machine, the machine comprising:

an enclosure including an output door;

a dispensing handle having a portion accessible from the exterior of said enclosure for actuation by the customer of said vending machine;

first and second plates in face-to-face relation within said enclosure and adapted for supporting therebetween a bundle of newspapers, the second plate positioned adjacent the output door;

biasing means urging said first plate toward said second plate, said biasing means including a bar rotatably mounted upon said machine and positioned on an opposite said of said second plate relative to said first plate, said biasing means further including an extension spring having a proximal length portion encircling said bar and a distal length portion extending from said bar through a plane containing said second plate and coupled to said first plate for urging said first plate toward said second plate; and dispensing means within said enclosure and responsive to actuation of said dispensing handle to slide one newspaper of said bundle out and said output door.

18. A newspaper vending machine according to claim 17 wherein said extension spring further provides newspaper bundle support in cooperation with a rail supporting said proximal length portion from below whereby said newspaper bundle may rest upon said extension spring as supported by said rail and remain relatively station with respect to said extension spring as said bundle advances toward said second plate under the influence of said biasing means.

* * * * *

UNITED STATES PATENT AND TRADEMARK OFFICE

CERTIFICATE OF CORRECTION

PATENT NO. : 5,205,437

DATED : April 27, 1993

INVENTOR(S) : Elder, et al

It is certified that error appears in the above-indentified patent and that said Letters Patent is hereby corrected as shown below:

Col. 13, line 31, delete "of".

Col. 15, line 23, change "newspapers" to --newspaper--;
line 60, change "relatively" to --selectively--.

Col. 16, line 57, change "station" to --stationary--.

Signed and Sealed this

Eleventh Day of January, 1994

Bruce Lehman

*Attest:*

BRUCE LEHMAN

*Attesting Officer*

*Commissioner of Patents and Trademarks*